United States Patent [19]

Ertley

[11] Patent Number: 4,682,699

[45] Date of Patent: Jul. 28, 1987

[54] WASTE RECYCLING KIT

[76] Inventor: Holmes E. Ertley, 699C Friar Ct., Lakehurst, N.J. 08733

[21] Appl. No.: 645,661

[22] Filed: Aug. 29, 1984

[51] Int. Cl.[4] ..... A47F 7/00

[52] U.S. Cl. ..... 211/71; 211/75; 248/DIG. 7

[58] Field of Search ..... 211/71, 75, 84, 88, 211/13; 248/DIG. 7, 156

[56] References Cited

U.S. PATENT DOCUMENTS

| | | | |
|---|---|---|---|
| 372,352 | 11/1887 | Bailey | 211/71 |
| 648,421 | 5/1900 | Moore et al. | 312/245 X |
| 950,097 | 2/1910 | Edgerton | 248/DIG. 7 |
| 1,550,043 | 8/1925 | Pearson | 248/DIG. 7 X |
| 2,491,652 | 12/1949 | Feerick | 211/71 |
| 3,298,533 | 1/1967 | Safford | 211/71 |
| 4,326,761 | 4/1982 | Schwartz | 312/245 X |
| 4,560,072 | 12/1985 | Bunell | 211/88 X |

*Primary Examiner*—Robert W. Gibson, Jr.
*Attorney, Agent, or Firm*—Harvey B. Jacobson

[57] ABSTRACT

A waste recycling kit by which trash can be separated into its categories at its source, placed into standard size supermarket grocery bags and delivered to a collection point, such as at curb side, while in the bag for maintaining categorization of the trash until it reaches a recycling facility. The kit includes a wall mounted organizer in the form of a rack having a plurality of compartments shaped and configured to receive supermarket paper bags with indicia designating the category of trash to be placed in each bag. The bags may be removed from the compartments and placed in an exterior container which may be an in-ground container or a wheeled container that may be oriented at curb side so that a plurality of the bags may be placed in the container for pickup by personnel attending a pickup vehicle which is constructed to maintain the separated trash categorized until it delivers the trash to a recycling facility.

4 Claims, 7 Drawing Figures

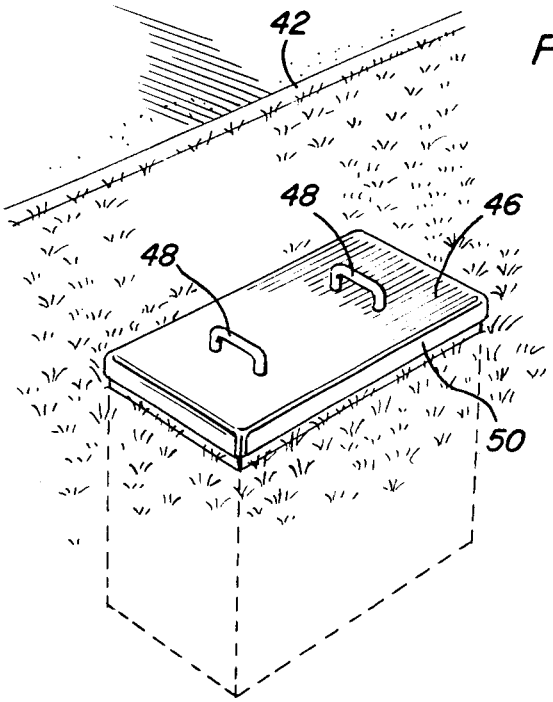
FIG. 4
FIG. 5
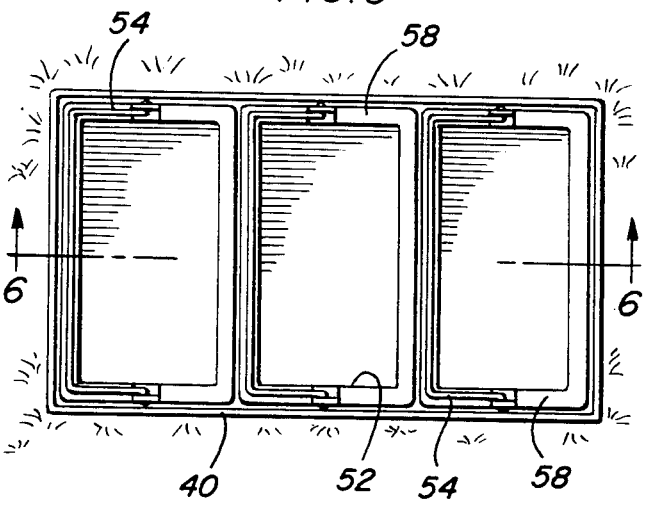
FIG. 6
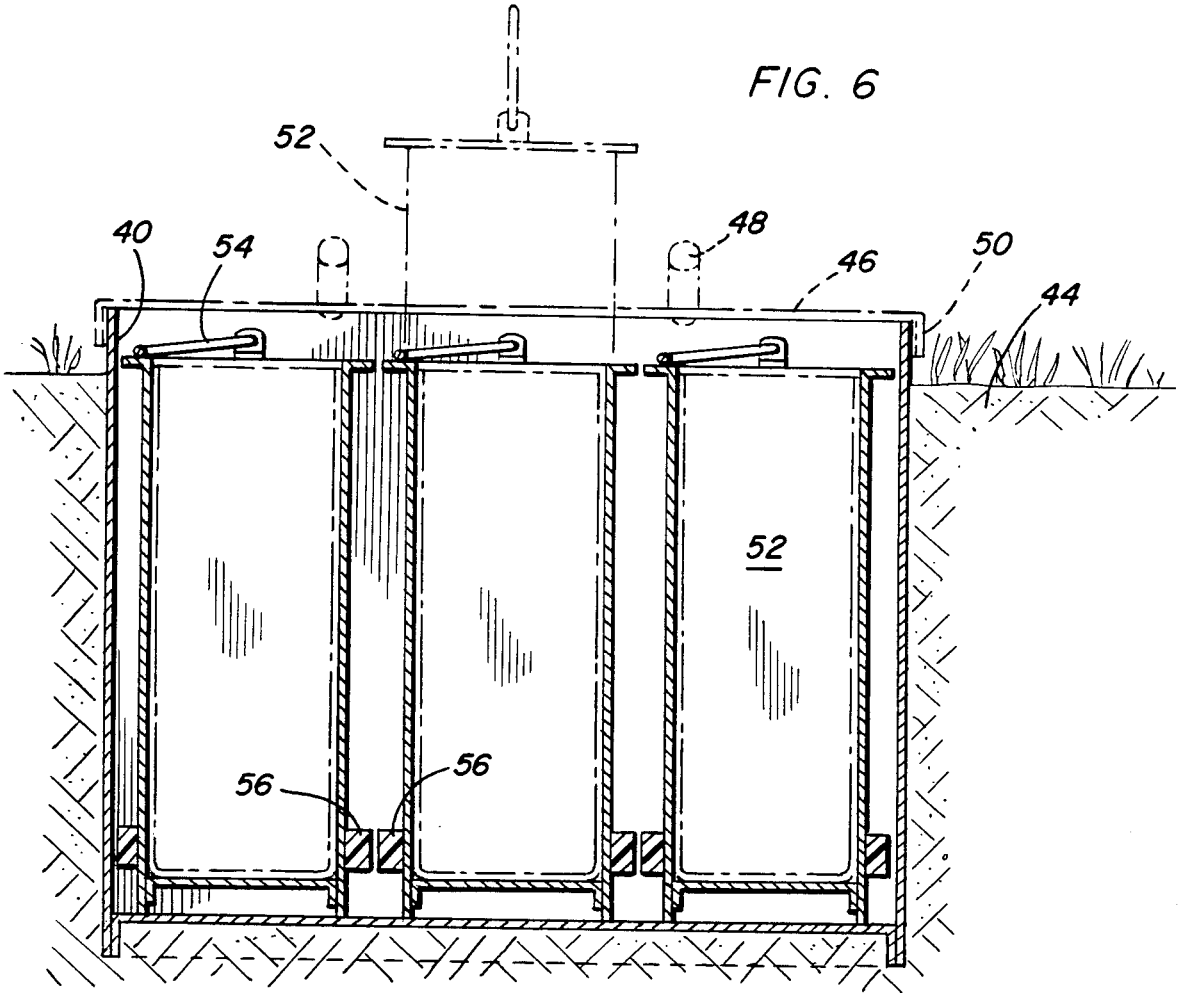

WASTE RECYCLING KIT

BACKGROUND OF THE INVENTION

1. Field of the Invention

The present invention generally relates to an apparatus or appliance for use in more efficient management of solid waste and facilitates recycling of waste material, trash and the like. Specifically, the present invention is a kit including a wall mounted recycling organizer in the form of an appliance mounted in a convenient location in a household or other source of trash which includes a supporting structure for a plurality of standard sized paper bags enabling trash to be separated into categories and placed in the separate bags or containers at the source or origin point of the trash. The kit also includes an exteriorly supported device oriented at curb side either in the form of a wheeled component or an in-ground component for storage of the paper bags or containers while awaiting pickup by a trash collecting vehicle so that the separation of the trash into predetermined categories may be maintained until it reaches a recycling facility.

2. Description of Related Art

Disposal of solid waste has become an increasingly difficult problem inasmuch as landfill areas are not available in many locations and are objectionable environmentally and also economically unfeasible. Some efforts have been made to recycle solid waste by separating it into categories and reusing the material or using it for other purposes. For example, paper, cardboard and the like can be separated and recycled as a paper product or can be used as a burnable product, metal components can be recycled and many other solid waste constituents can be reused or used for useful purposes when properly separated. While many efforts have been made to more efficiently manage solid waste, one of the many problems which still exist is the difficulty in separating solid waste or trash into different categories after it has been mixed together and transported to a recycling facility. The following U.S. patents are indicative of the development of the prior art in this field of endeavor.

U.S. Pat. No. 3,185,339
U.S. Pat. No. 3,856,173
U.S. Pat. No. 4,009,792
U.S. Pat. No. 4,094,664
U.S. Pat. No. 4,113,125
U.S. Pat. No. 4,175,903
U.S. Pat. No. 4,285,624
U.S. Pat. No. 4,310,279

SUMMARY OF THE INVENTION

An object of the present invention is to provide a waste recycling kit for use as part of a solid waste management program which includes an appliance in the form of a recycling organizer mounted at a convenient location at the source of the trash such as in a household, office or the like with the organizer including a rack type structure supporting a plurality of standard size paper bags such as those utilized in grocery stores, supermarkets and the like so that the trash can be categorized and deposited into separate bags with this separation and categorization being maintained by providing an exterior appliance for storing the bags in separate compartments until picked up by a pickup vehicle with the exterior device being either an in-ground storage device or a wheeled storage device to facilitte positioning of the categorized trash in paper bags at curb side or other convenient location for pickup by a vehicle or the like.

A further object of the invention is to provide a waste recycling organizer which is wall mounted in a convenient and accessible location with rack space being provided for a plurality of standard size paper bags together with indicia indicating the category of trash to be placed in each bag so that the bags with the trash therein can be easily removed from the organizer and placed in the exterior device so that separation or categorization may be maintained at the source or point of origin of the trash until it is picked up by a pickup vehicle which also may be specially constructed for maintaining categorization until the separated and categorized trash reaches a recycling facility.

Another object of the invention is to provide a waste recycling kit in which the exterior device may be mounted in-ground at curb side and provided with a removable cover and removable containers to facilitte storage of paper bags having categorized trash therein and also facilitate removal thereof from the in-ground facility.

A still further object of the invention is to provide a waste recycling kit in accordance with the preceding objects which is extremely simple in construction and relatively inexpensive to manufacture and maintain but yet which will efficiently enable separation of trash into different categories and maintain the separation from the source of the trash to a recycling plant.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the waste recycling organizer in the form of a wall mounted rack oriented interiorly of a home or other living space, an office or the like.

FIG. 4 is a perspective view of an exteriorly mounted device or curb box having a removable cover and a plurality of removable containers for receiving the paper bags having the categorized trash therein.

FIG. 5 is a top plan view of the device illustrated in FIG. 4 with the top removed.

FIG. 6 is a vertical sectional view, on an enlarged scale, taken substantially upon a plane passing along section line 6—6 on FIG. 5 illustrating further structural details of the in-ground container or curb box.

DESCRIPTION OF THE PREFERRED EMBODIMENT

Figure 1:
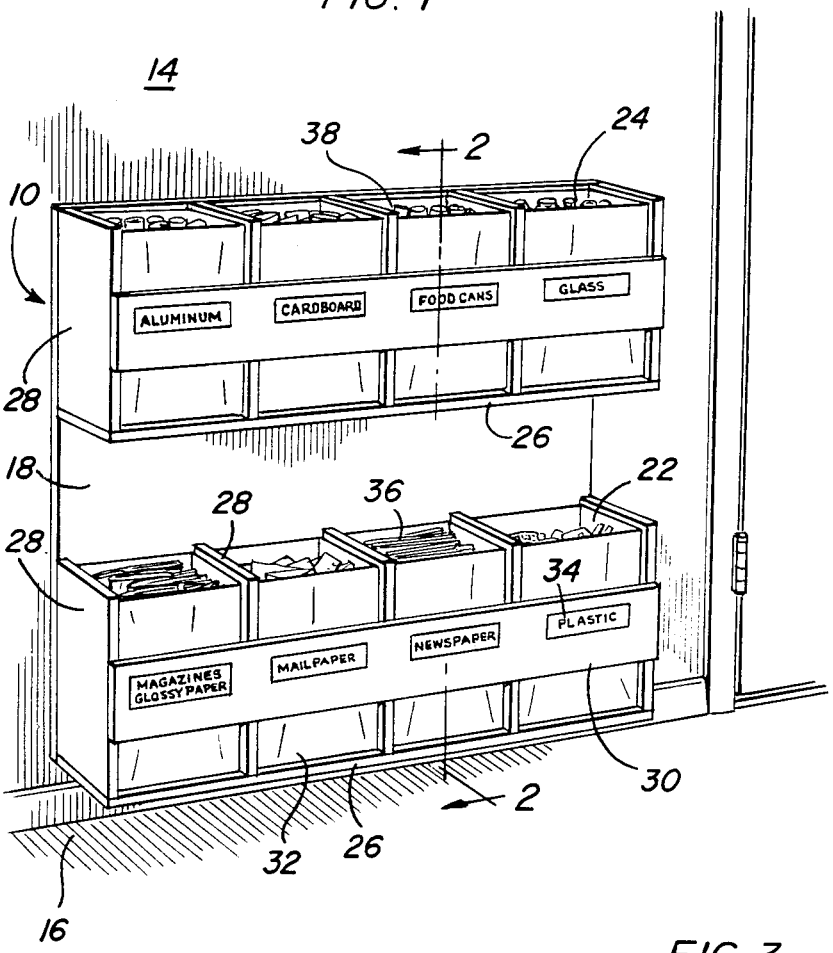
Figure 2:
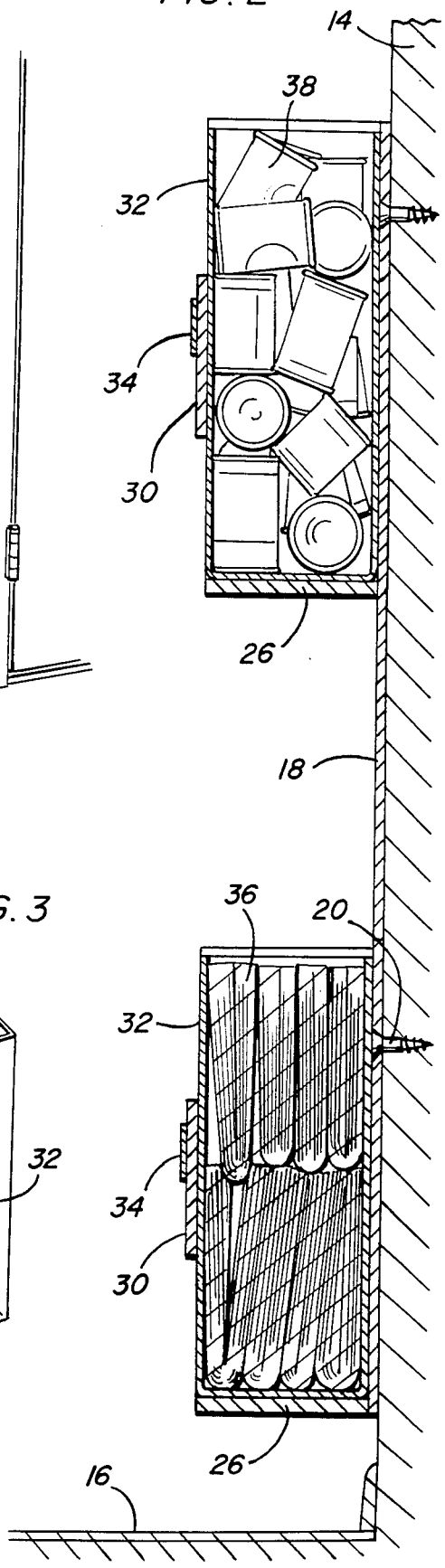
FIG. 2 is a vertical sectional view, on an enlarged scale, taken substantially upon a plane passing along section line 2—2 on FIG. 1 illustrating further structural details of the organizer.
Figure 3:
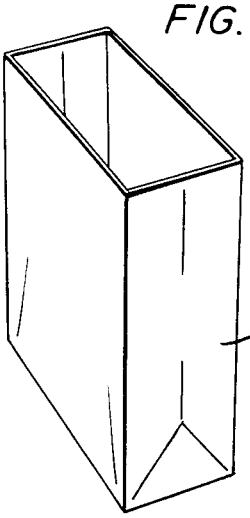
FIG. 3 is a perspective view of one of the paper bags used in the waste recycling organizer of FIGS. 1 and 2.
Figure 7:
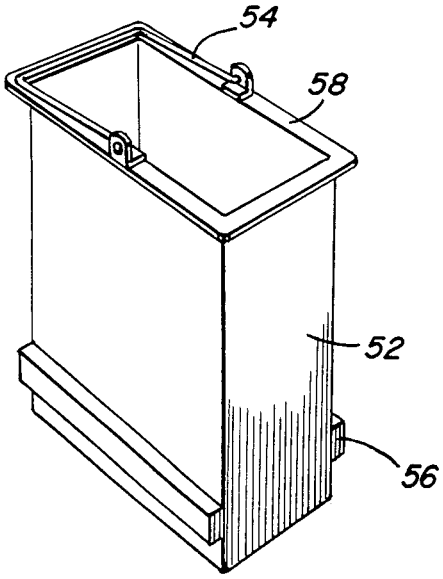
FIG. 7 is a perspective view of one of the removable containers in the in-ground container.

Referring now specifically to the drawings, the waste recycling kit of the present invention includes a wall mounted recycling organizer 10 illustrated in FIGS. 1 and 2 and an exteriorly mounted device in the form of a curb box or in-ground container generally designated by numeral 12 and illustrated specifically in FIGS. 4–6.

The wall mounted recycling organizer 10 is in the form of an appliance that is mounted vertically on a wall surface 14 or other suitable supporting surface above a floor 16. The organizer 10 may be mounted in a convenient location in a home, apartment, office or the like or other source of trash and includes a vertical panel 18 secured to the wall 14 by fasteners such as screw-threaded members 20 or the like. The shape, size and configuration of the organizer may be varied depending upon space available and includes a pair of vertically spaced rows of compartments 22 and 24 with each row being defined by a bottom shelf-like member 26, a plurality of vertical partitions 28 two of which form end members and a front panel 30 which has a height less than the height of the partitions 28 as illustrated in FIG. 1 with the compartments 22 and 24 receiving paper bags 32 which are in the form of standard size grocery bags such as those used in grocery stores, supermarkets and the like with the vertical height of the compartments 22 and 24 being substantially the same as the vertical height of the bags 32 with the front panel 30 being of less height as illustrated in FIGS. 1 and 2. Also, the front panel 30 is provided with a plurality of labels 34 thereon having indicia designating the category of trash to be placed in the particular bag in that compartment. For example, as illustrated in FIG. 2, the lower bag 32 has newspapers 36 placed therein whereas the upper bag 32 has cans 38 placed therein. Thus, by mounting the organizer 10 on a wall, such as a kitchen wall in a home, apartment or the like or in a convenient location in the home, office, apartment or any other source of trash, relatively inexpensive and readily available standard size brown paper bags 32 may be utilized by placing them in the compartments 22 and 24 with the top open so that different categories of trash or solid waste can be placed therein. With the categories arranged as indicated, substantially all types of solid waste can be categorized as it becomes available at the source. If desired, the upper end of the paper bags 32 can be temporarily closed and, if desired, the organizer 10 can be concealed by using a room divider, folding partition, curtains, drapes and the like. The paper bags 32 can be easily removed from the compartments 22 and 24 when they become full or at the time of collection of trash by a pickup vehicle or the like or the bags can be removed for easy transport to a recycling plant or other collection facility for categorized trash.

The curb box or in-ground container 12 is illustrated in detail in FIGS. 4–7 and includes a container 40 positioned adjacent a curb 42 in the ground surface 44 with the upper end thereof projecting slightly above the ground surface and being provided with a removable lid 46 having a handle or handles 48 thereon and a depending peripheral lip 50 telescoping over the open upper end of the container 40. The container 40 is constructed of a size to receive standard paper bags 32 which may be merely positioned side by side in the container 40 or positioned in removable containers 52 which have an open upper end and a pivotal handle or bail 54 attached thereto and side spacers 56 adjacent the bottom edge and a peripheral flange 58 at the upper edge so that the containers will be maintained in a straight, vertical parallel relationship as illustrated in FIG. 6 and the containers can be easily removed to facilitte insertion of and removal of the paper bags 32 therein. With this construction, a plurality of the paper bags 32 may be placed in the containers 52 in the curb box 12 so that a pickup vehicle and personnel associated therewith may easily remove the lid 46 and remove the paper bags 32 either by grasping the bags 32 or by raising the containers 52 and then removing the bags 32 therefrom. While the container 40 has been illustrated as being in-ground, the container 40 may be also constructed as a wheeled container such as with two wheels at one end and a handle at the other so that it can be wheeled to a desired location such as adjacent curb side so that the paper bags 32 can be readily accessible to pickup vehicle and personnel associated therewith. Also, as indicated above, the container 40 may be provided with no compartments or partitions or it may be provided with the containers 52 or permanently installed partitions similar to the partitions illustrated in the wall mounted organizer 10 in order to form compartments conforming generally with the dimensional characteristics of the standard size grocery bags 32. Also, while all of the compartments have been shown as the same size, they may be varied to accept different sized grocery bags or other standard size bags which are readily available and which are usually disposed of after groceries have been removed therefrom thus making use of a grocery bag which usually is merely thrown away.

The components of the organizer 10 may be wood, plastic, metal, fiberboard or other similar building materials and the in-ground container may be metal, plastic, cementitious material, wood or the like and the wheeled container may be constructed of lightweight metal, plastic, wood, or other materials and, if desired, the lid may be provided with latching devices or other hold-down devices to assure that it is retained in place to prevent access to the trash by animals such as dogs, cats, raccoons and the like.

While the categories of household trash may vary, typical categories are indicated on the drawings and while standard size supermarket bags 32 are illustrated which are 17 inches high, 7 inches wide and 12 inches long, this size may vary since there are other standardized bag sizes. The container 20 may be conveniently 20 inches in height and as long as desired for receiving a predetermined number of bags 32 or containers or pails 52. Plastic materials may be used in both the organizer 10 and the exterior device 12 if desired which is lightweight, long lasting and may be colored in any desired color. Garbage, kitchen waste, wet paper and other wet or odor producing materials may be placed in leak proof plastic containers or flexible bags which are sealed and placed in the paper bags 32 for subsequent pick-up. The leak proof bag will maintain its integrity until it reaches its destination.

Thus, by using the concept of separating the trash at its source and maintaining that separation until the trash is delivered to a recycling plant or other facility, a more efficient, environmentally sound and economically feasible solid waste management system is obtained. Further, this method upgrades the process of disposal of trash or discarded material by presenting only clean, dry and environmentally acceptable products to pick-up and recycling personnel.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A waste recycling kit comprising a supporting rack for positioning at a convenient location adjacent a source of trash, said rack including a plurality of vertically opening compartments with each compartment including indicia designating that compartment receiving a predetermined category of trash, and a disposable bag oriented in each compartment for receiving trash designated for that compartment whereby the categorized trash may be removed from the track along with the bag to facilitate its transport to a recycling facility, an exteriorly mounted container dimensioned to receive a plurality of bags and a cover for said container to protect and retain the bags with categorized trash therein for pickup by a vehicle and personnel, said container being located in-ground adjacent curb side, and a plurality of removable containers in said in-ground containers, each removable container including a bail handle and dimensioned to receive a single bag.

2. The structure as defined in claim 6 wherein said rack includes a substantially vertical panel adapted to be mounted on a wall surface, a plurality of horizontally oriented and vertically spaced compartments formed on said panel including a front wall, a bottom and side walls for each compartment with the front wall being of lesser height than the side walls to facilitate positioning and removal of bags with or without categorized trash therein.

3. The structure as defined in claim 2 wherein said bags are standard size paper grocery bags normally discarded after removal of groceries therefrom.

4. A kit facilitating recycling of waste material comprising a rack supported adjacent a source of different types of waste material, said rack including a plurality of separate compartments, means associated with the compartments for visually indicating the type of waste material to be placed in each compartment, a removable container placed in each compartment for receiving waste material placed therein, a box supported in spaced relation to the rack and adjacent a pick up point for waste material, said box including an openable sealed lid to enable placement of separated waste material packaged in said removable containers for storage until picked up with the box projecting and maintaining the integrity of the separated packaged waste material during storage in the box, said box including a plurlity of removable receptacles with each receptacle receiving one of said removable containers and maintaining it in separate relation to other removable containers, each removable receptacle in the box including a pivotal bail handle for positioning under the lid when folded downwardly against the top of the removable receptacle, said removable receptacles being dimensioned to substantially completely fill the interior of the box when disposed therein with each removable receptacle including an outwardly projecting top edge flange and lateral spacers at the bottom to retain the removable receptacles in generally parallel relation within the box.

* * * * *